US010626738B2

(12) United States Patent
Ju

(10) Patent No.: US 10,626,738 B2
(45) **Date of Patent: *Apr. 21, 2020**

(54) ROTATING PART, METHOD OF FABRICATING THE SAME, AND STEAM TURBINE INCLUDING THE SAME

(71) Applicant: DOOSAN HEAVY INDUSTRIES & CONSTRUCTION CO., LTD., Changwon-si, Gyeongsangnam-do (KR)

(72) Inventor: Jae Min Ju, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 122 days.

This patent is subject to a terminal disclaimer.

(21) Appl. No.: 15/954,576

(22) Filed: Apr. 16, 2018

(65) Prior Publication Data

US 2018/0313218 A1 Nov. 1, 2018

(30) Foreign Application Priority Data

Apr. 28, 2017 (KR) ..... 10-2017-0055423

(51) Int. Cl.
*F01D 5/32* (2006.01)
*F01D 5/30* (2006.01)

(52) U.S. Cl.
CPC ..... *F01D 5/32* (2013.01); *F01D 5/3046* (2013.01); *F05D 2220/31* (2013.01); (Continued)

(58) Field of Classification Search
CPC ..... F05D 2230/60; F05D 2260/30; F01D 5/3045; F01D 5/32
See application file for complete search history.

(56) References Cited

U.S. PATENT DOCUMENTS 2,199,243 A * 4/1940 Mortimer ..... F01D 5/225 416/217
5,511,948 A 4/1996 Suzuki et al.
(Continued)

FOREIGN PATENT DOCUMENTS

JP S61129403 A 6/1986
JP 6361702 A 3/1988

OTHER PUBLICATIONS

An European Search Report dated Sep. 21, 2018 in connection with European Patent Application No. 18169470.4 which corresponds to the above-referenced U.S. application.

*Primary Examiner* — Ninh H. Nguyen
(74) *Attorney, Agent, or Firm* — Invenstone Patent, LLC

(57) ABSTRACT

A rotatable body includes a rotor and n buckets, each bucket being coupled to the rotor in a tangential entry manner. The rotor supports each of the n buckets coupled to the rotor, so the buckets may be stably coupled to the rotor, using a unified annular dovetail tenon that protrudes axially from the rotor. Each bucket includes a bucket dovetail mortise for engaging with the unified annular dovetail tenon in order to couple the bucket to the rotor. A method of manufacturing the rotatable body includes assembling first to (n−1)th buckets with the rotor wheel by successively inserting the first to (n−1)th buckets through the tangential entry; assembling the nth bucket with the adapter; assembling the adapter with the rotor wheel, by inserting the adapter assembled with the nth bucket into the tangential entry; and collectively moving all the buckets by one half pitch in the circumferential direction.

18 Claims, 10 Drawing Sheets

(52) U.S. Cl.
CPC .... *F05D 2230/60* (2013.01); *F05D 2240/128* (2013.01); *F05D 2240/14* (2013.01); *F05D 2240/24* (2013.01); *F05D 2260/36* (2013.01)

(56) References Cited

U.S. PATENT DOCUMENTS

| | | | | |
|---|---|---|---|---|
| 6,499,959 | B1 * | 12/2002 | Reluzco | F01D 5/3046 416/215 |
| 7,261,518 | B2 * | 8/2007 | Golinkin | F01D 5/3007 416/215 |
| 8,894,372 | B2 * | 11/2014 | Willett, Jr. | F01D 5/32 416/220 R |
| 2012/0099999 | A1 | 4/2012 | Bhokardole et al. | |

* cited by examiner

【FIG 1】
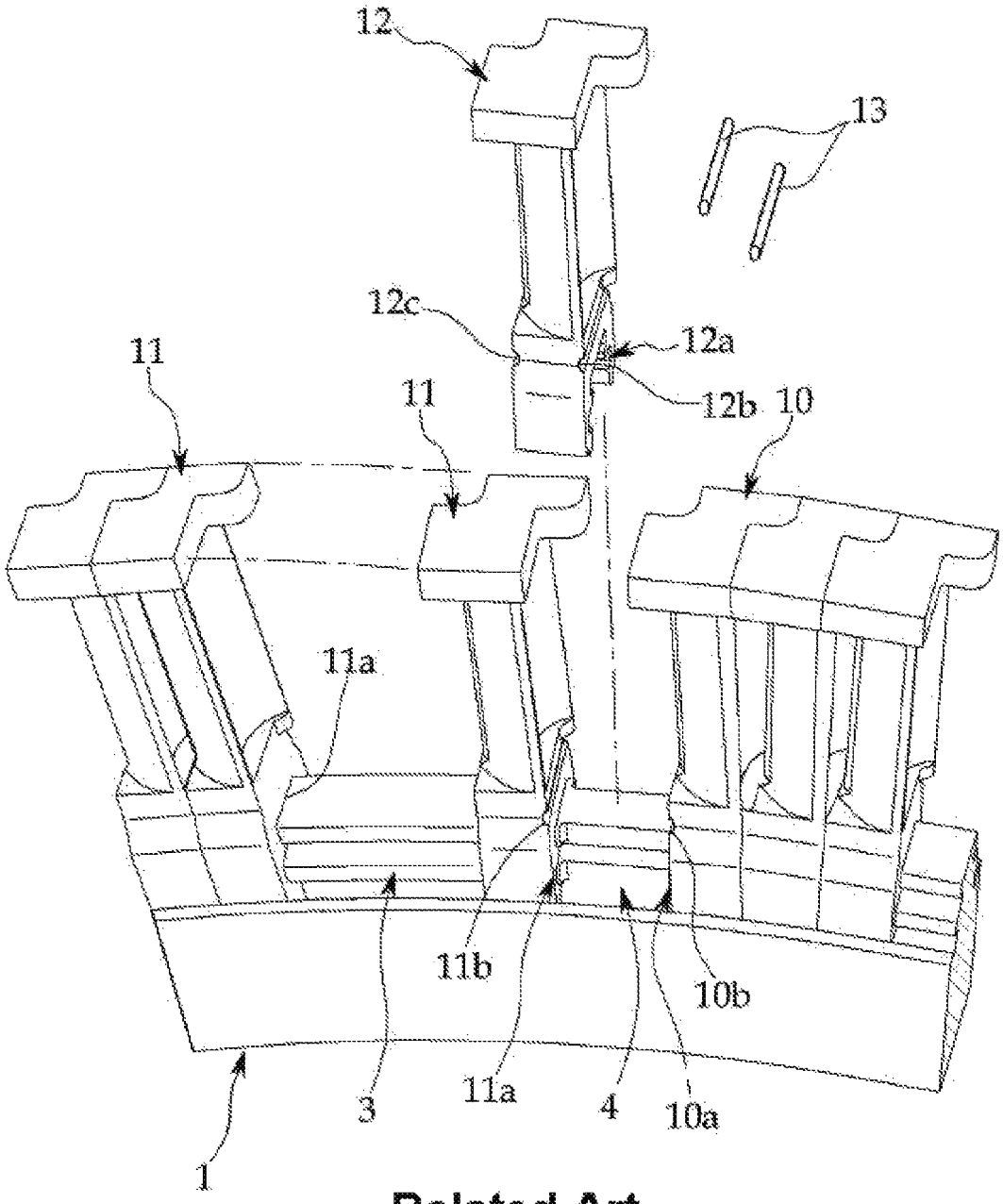
Related Art

【FIG 2】
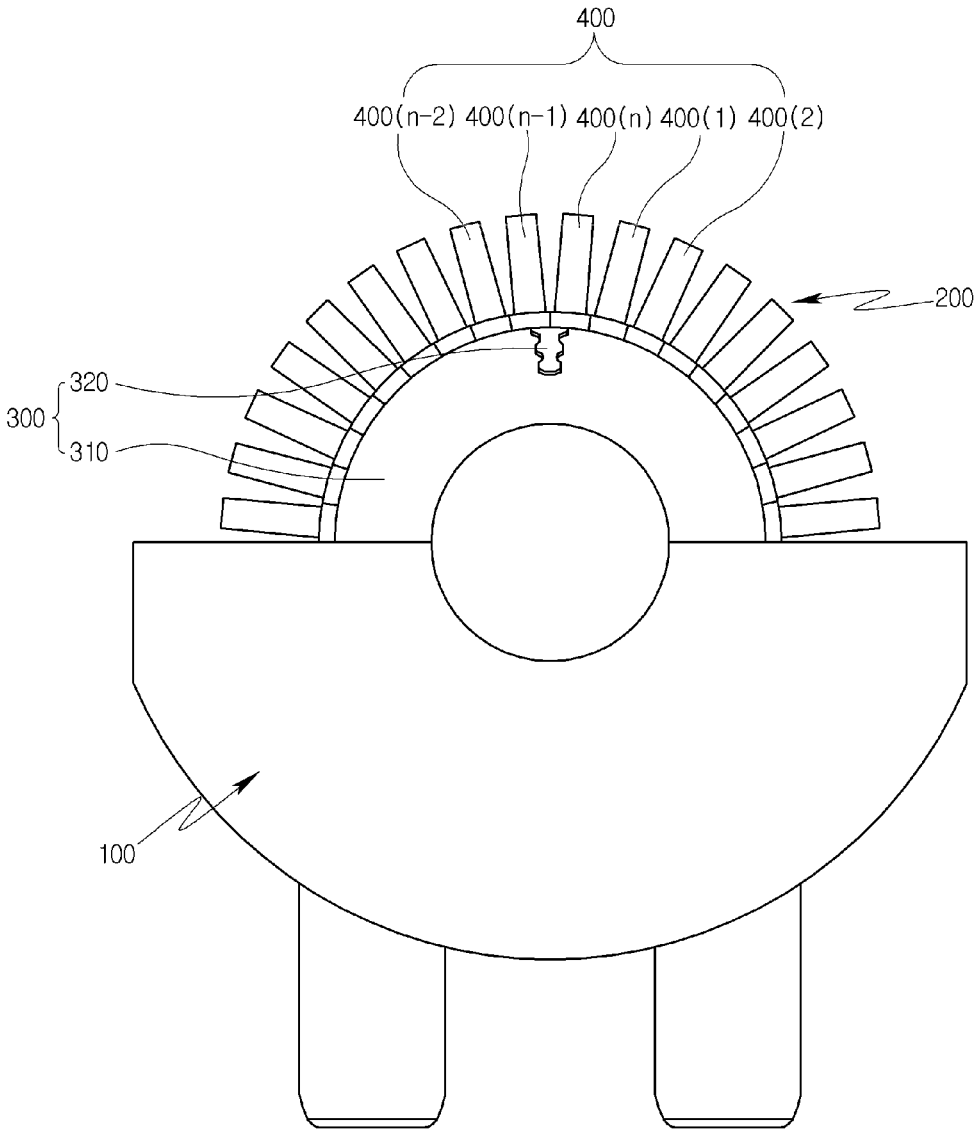

【FIG 3】
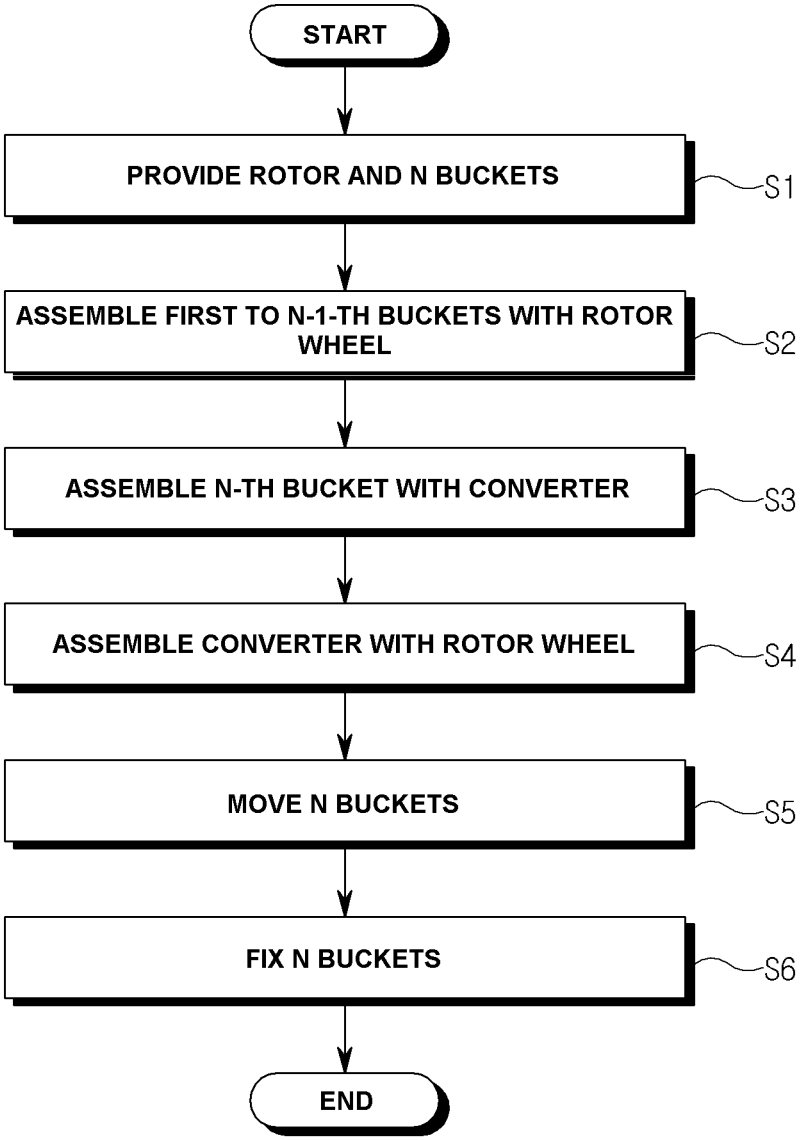

【FIG 4】
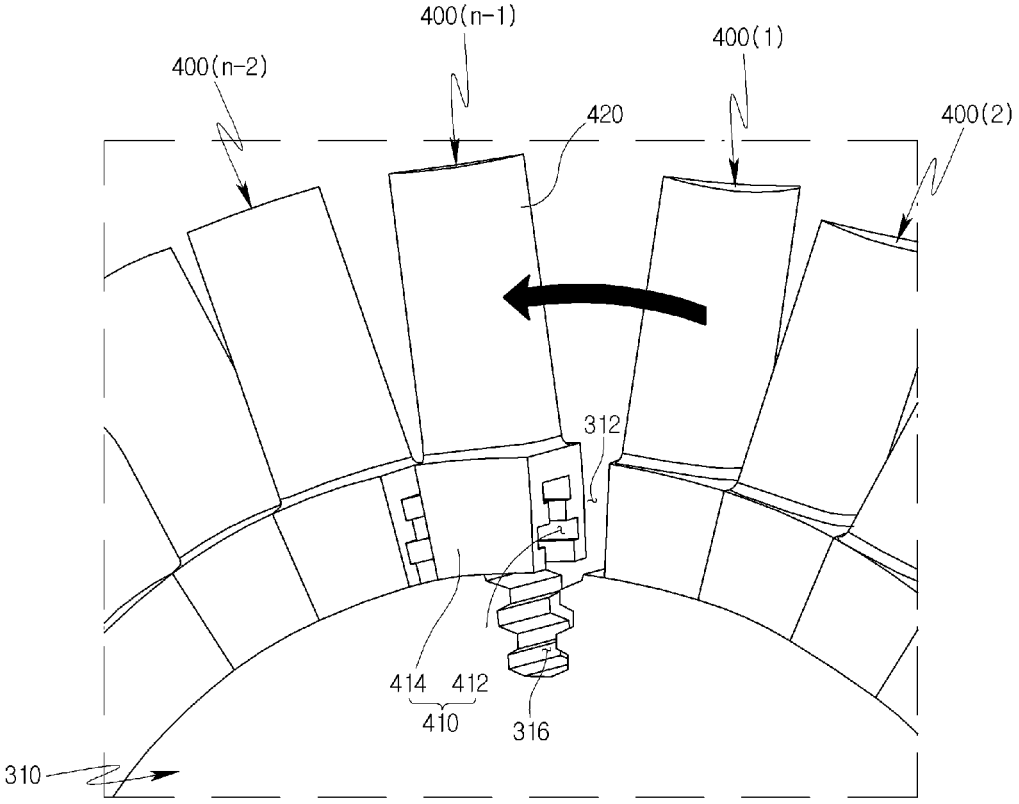

【FIG 5】
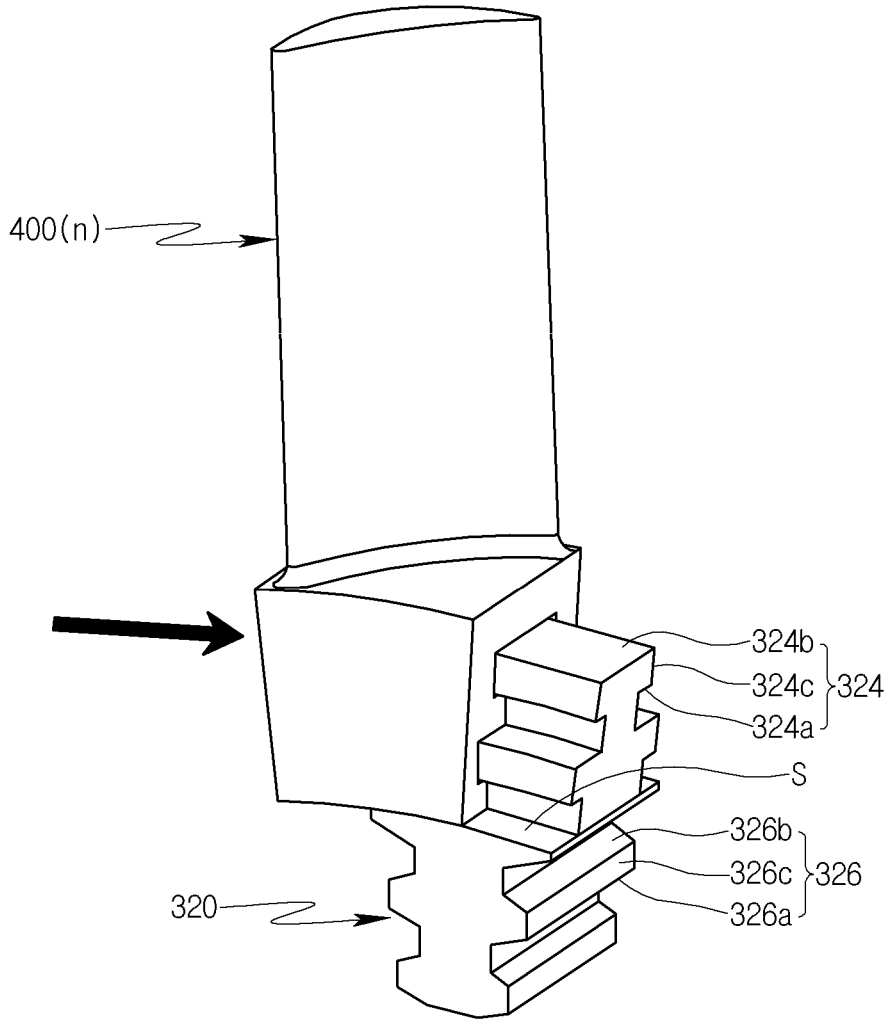

【FIG 6】
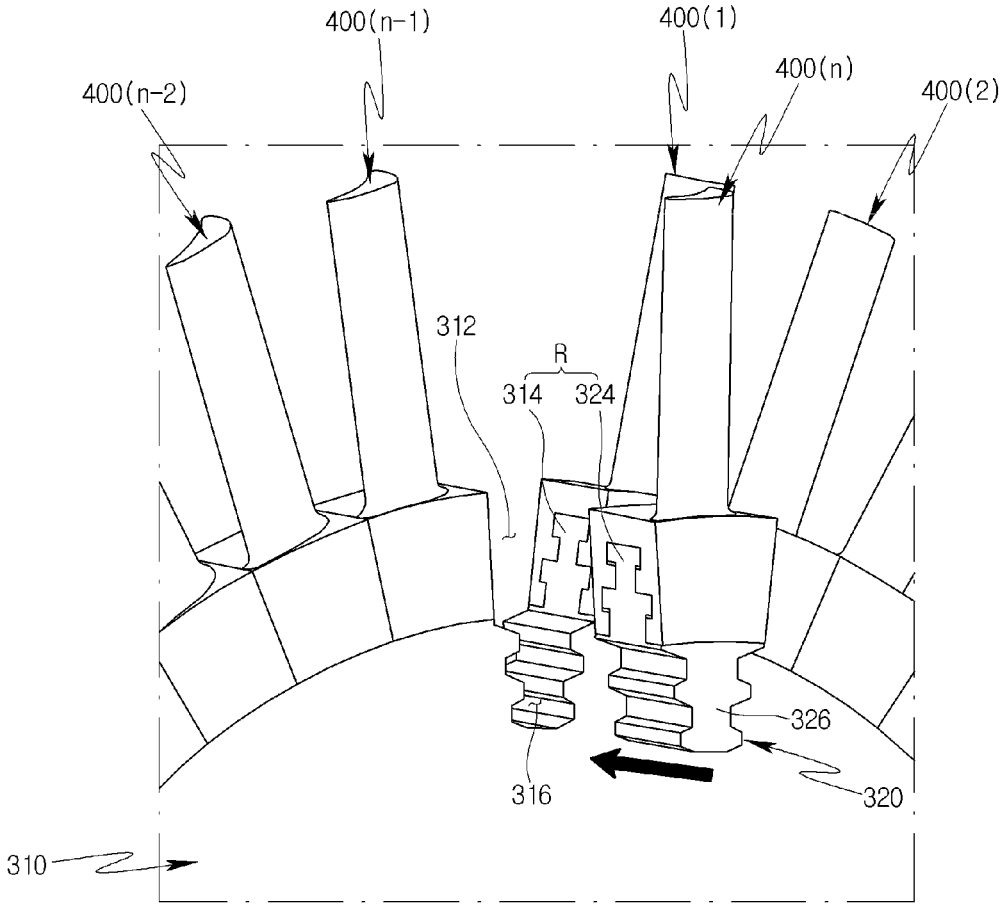

【FIG 7】
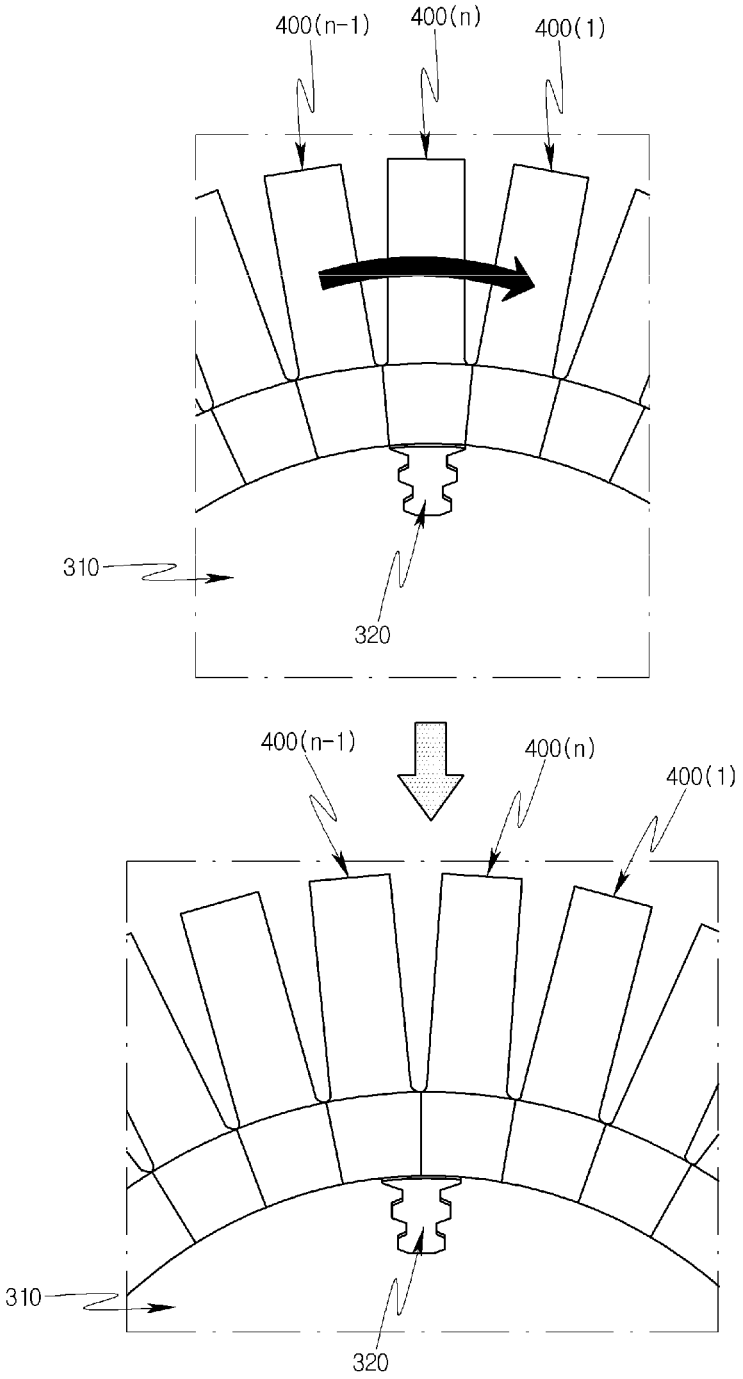

【FIG 8】
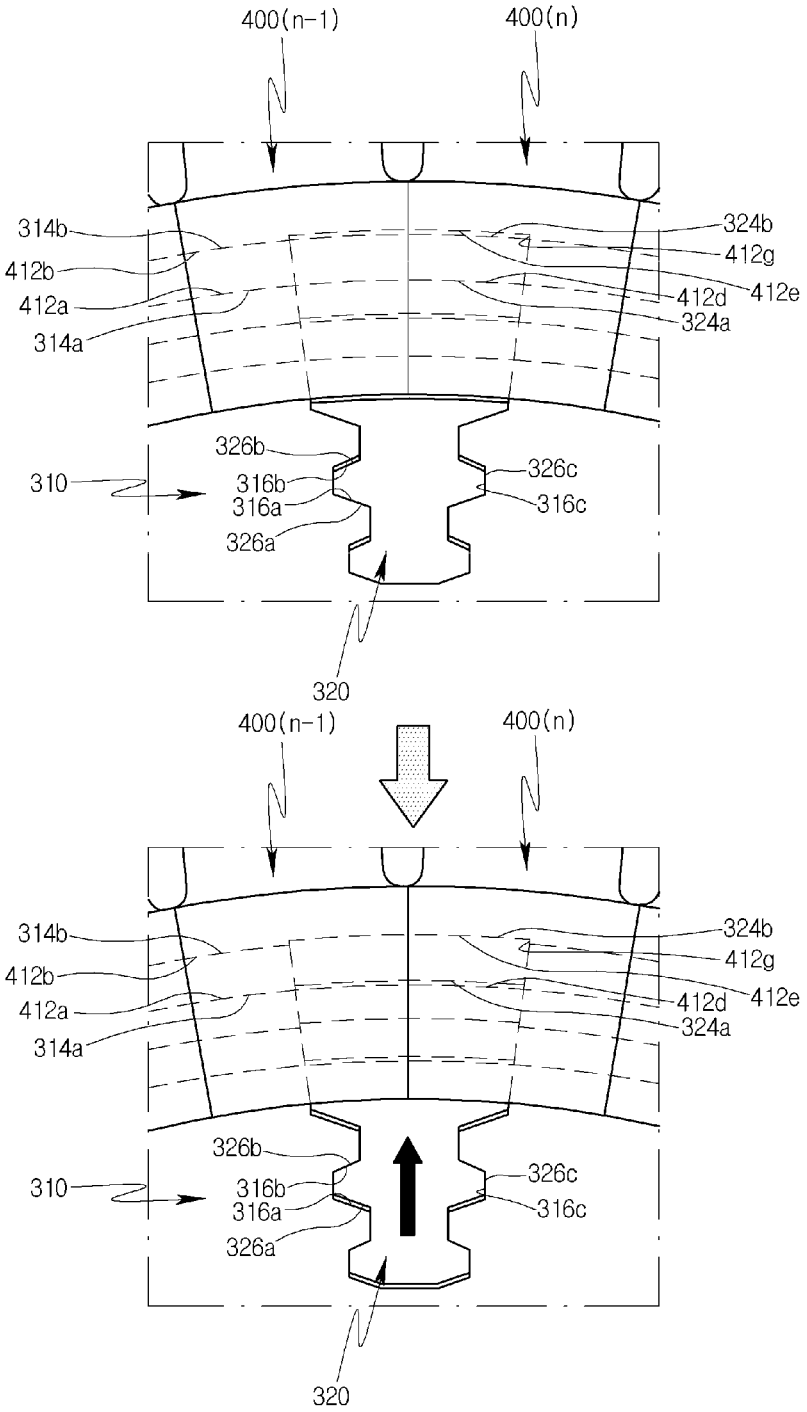

【FIG 9】
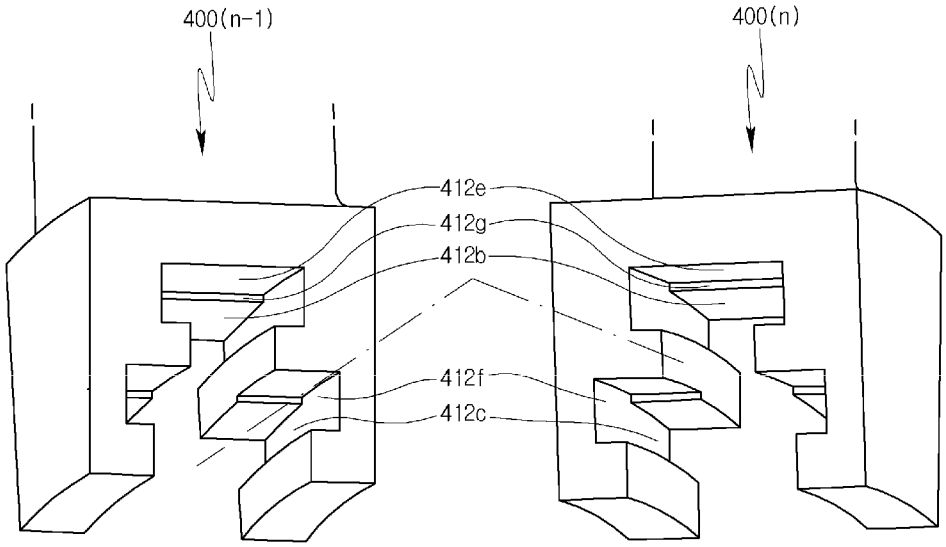

【FIG 10】
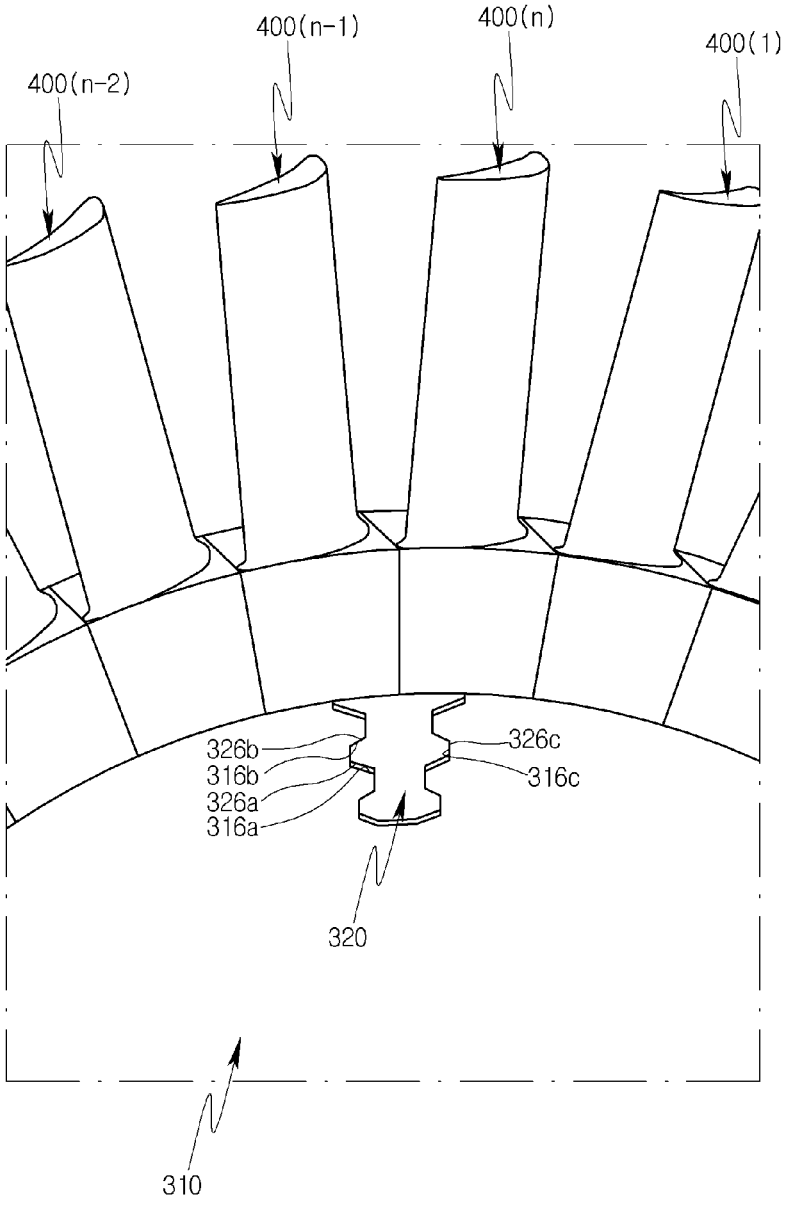

ROTATING PART, METHOD OF FABRICATING THE SAME, AND STEAM TURBINE INCLUDING THE SAME

CROSS-REFERENCE TO RELATED APPLICATIONS

The present application claims priority to Korean Patent Application No. 10-2017-0055423, filed Apr. 28, 2017, the entire contents of which is incorporated herein for all purposes by this reference.

BACKGROUND OF THE INVENTION

Field of the Invention

Exemplary embodiments of the present invention relate to a rotatable body, a method of manufacturing the rotatable body, and a steam turbine including the rotatable body, and more particularly, to a rotatable body configured to enable buckets to be stably coupled to the rotor in a tangential entry manner, a method of manufacturing the rotatable body, and a steam turbine including the rotatable body.

Description of the Related Art

Generally, a turbine is a machine which converts the energy of fluid such as water, gas, or steam into mechanical work. Typically, a turbo machine, in which a plurality of blades are fitted around a circumferential portion of a rotatable body so that the rotatable body is rotated at a high speed by discharging steam or gas toward the blades, is referred to as a turbine.

Such turbines may be classified into, among others, a water turbine using the energy of elevated water; a steam turbine using the energy of flowing steam; a gas turbine using the energy of high-temperature, high-pressure gas; and an air turbine using the energy of high-pressure, compressed air. Among these, a steam turbine is configured to convert steam energy into mechanical work by rotating a rotatable body using steam projected onto blades from a nozzle. Such a steam turbine includes a casing which forms an outer appearance and frame of the turbine, the rotatable body rotatably installed in the casing, and the nozzle configured to discharge steam toward the rotatable body.

Korean Patent No. 10-1376716 discloses a rotatable body and a steam turbine including the same, in which a related art rotatable body includes a rotor and a plurality of buckets coupled to the rotor and configured to convert the energy of flowing steam discharged from a nozzle (not shown) into mechanical work. Here, a number (n) of buckets are coupled to a rotor in a so-called tangential entry manner, in which each bucket is installed by inserting it into a tangential entry and then sliding the inserted bucket in a circumferential direction of the rotor.

Referring to FIG. 1, a rotor 1 has the basic shape of a flat, circular plate, i.e., a disc. A tangential entry 4 providing passage for installing n buckets 10, 11, 12 is formed at a predetermined position in a circumferential portion of the rotor 1. A rotor dovetail tenon 3 for supporting the installed buckets 10 and 11 is provided on the circumferential portion of the rotor 1 and extends along a circumferential surface of the rotor 1, between opposite sides of the tangential entry 4, leaving a gap corresponding to the predetermined position of the tangential entry 4.

On the one hand, each of the n buckets 10, 11, 12 includes a root having a bucket dovetail mortise 10*a*, 11*a*, 12*a* capable of engaging with the rotor dovetail tenon 3, and a blade protruding from the root in the rotor's radial direction, whereby the first through (n−1)th buckets 10 through 11 are supported by the rotor dovetail tenon 3. On the other hand, the nth bucket 12 is supported by a pair of separately provided pins 13. That is, the nth bucket 12, which is a closer bucket that is last to be installed, is supported by a pair of separately provided pins 13, because the nth bucket 12 is merely inserted into the tangential entry 4.

In detail, a first groove 12*b* is formed in a first side surface of the root of the nth bucket 12, and a third groove 10*b* is formed in an opposing side surface of the root of the first bucket 10 that is adjacent to the nth bucket 12. The first and third grooves 12*b* and 10*b* are formed as recesses in the rotor's circumferential direction, and when combined, the opposing recesses form a first pin hole into which a first pin 13 is to be inserted. Meanwhile, a second groove 12*c* is formed in a second side surface of the root of the nth bucket 12, and a fourth groove 11*b* is formed in an opposing side surface of the root of the (n−1)th bucket 11 that is adjacent to the nth bucket 12. The second and fourth grooves 12*c* and 11*b* are, likewise, formed as recesses in the rotor's circumferential direction, and when combined, the opposing recesses a second pin hole into which a second pin 13 is to be inserted. In the foregoing configuration, one side of the nth bucket 12 is supported by the first bucket 10 through the first pin 13 inserted into the first pin hole, while the other side of the nth bucket 12 is supported by the (n−1)th bucket 11 through the second pin 13 inserted into the second pin hole.

The related art rotatable body having the above configuration is manufactured as follows.

The first through (n−1)th buckets 10 through 11 are successively coupled to the rotor 1 by individually inserting the first through (n−1)th buckets 10 through 11 into the tangential entry 4 and then sliding them in the rotor's circumferential direction along the rotor dovetail tenon 3 using the respective bucket dovetail mortises 10*a* through 11*a* of the buckets 10 through 11. Lastly, the nth bucket 12 is inserted into the tangential entry 4, and with the nth bucket 12 thus positioned, the first and second pins 13 are respectively inserted into the first and second pin holes.

However, in the above-described rotatable body and method of manufacturing the same according to the related art, the buckets are not stably coupled to the rotor. That is, because the nth bucket 12 is supported by the first (n−1)th buckets 10 and 11 rather than being supported by the rotor dovetail tenon 3, a significant amount of load is applied to each of a coupling portion between the first bucket 10 and the rotor 1 and a coupling portion between the (n−1)th bucket 11 and the rotor 1. These coupling portions may therefore be damaged by the applied load, such that the corresponding buckets may become unstably coupled, that is, loosened or separated from the rotor 1. A significant amount of load is also applied to the first pin 13, the first pin hole, the second pin 13, and the second pin hole, which may likewise be damaged, such that the associated buckets may similarly become unstably coupled to the rotor 1. In addition, the nth bucket 12 may become separated from the rotor 1 through an undesirable shifting in the rotor's axial direction. Furthermore, during operation of a steam turbine including a rotatable body according to the related art, the n buckets 10, 11, 12 may rotate relative to the rotor 1, that is, the buckets may collectively experience a shifting in the rotor's circumferential direction, in which case there is a reduction in efficiency.

SUMMARY OF THE INVENTION

An object of the present invention is to provide a rotatable body configured to enable a bucket to be stably coupled to a rotor, a method of manufacturing the rotatable body, and a steam turbine including the rotatable body.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a rotatable body may include a rotor; and n buckets for converting energy of flowing steam into mechanical work, each bucket configured to be coupled to the rotor in a tangential entry manner, wherein the rotor is configured to support each of the n buckets coupled to the rotor.

The rotatable body may further include a unified annular dovetail tenon protruding axially from a circumferential surface of the rotor. Each of the n buckets may include a bucket dovetail mortise for engaging with the unified annular dovetail tenon in order to couple the bucket to the rotor.

The rotor may include an adapter for coupling an nth bucket of the n buckets to the rotor; and a rotor wheel having a circumferential surface on which a tangential entry is provided, wherein the adapter fills the tangential entry when the nth bucket is coupled to the rotor.

The adapter may be configured to be coupled to the rotor wheel by moving the adapter in an axial direction of the rotor, and the rotor wheel may include an axial dovetail mortise, extending in an axial direction of the rotor, configured to receive the adapter at the tangential entry.

The rotor wheel may include a rotor dovetail tenon extending in a circumferential direction of the rotor from one side of the tangential entry to the other side of the tangential entry, the rotor dovetail tenon having a gap at the tangential entry.

The adapter may include an adapter dovetail tenon configured to fill the gap in the rotor dovetail tenon when the nth bucket is coupled to the rotor.

The rotor dovetail tenon and the adapter dovetail tenon may form a unified annular dovetail protrusion protruding axially from a circumferential surface of the rotor. Each of the n buckets may include a root including a bucket dovetail mortise to engage with a portion of the unified annular dovetail protrusion; and a blade protruding from the root in a radial direction of the rotor. With respect to the circumferential direction of the rotor, a length of the tangential entry, a length of the adapter dovetail tenon, a length of the root, and a length of the bucket dovetail mortise may be substantially identical lengths.

First to (n−1)th buckets may be inserted through the tangential entry and then slid in the circumferential direction of the rotor on the rotor dovetail tenon in order to successively assemble the first to (n−1)th buckets with the rotor wheel. An nth bucket may be assembled with the adapter and the adapter assembled with the nth bucket is inserted into the tangential entry in an axial direction of the rotor in order to assemble the nth bucket with the rotor wheel. The first to (n−1)th buckets assembled with the rotor wheel and the nth bucket assembled with the adapter are collectively moved to a predetermined position along the circumferential direction of the rotor, so that the (n−1)th bucket axially and radially overlaps a first junction between the rotor dovetail tenon and the adapter dovetail tenon, and the nth bucket axially and radially overlaps a second junction between the rotor dovetail tenon and the adapter dovetail tenon.

When a length of a bucket of the n buckets with respect to the circumferential direction of the rotor is one pitch, the predetermined position may be a position to which the first to (n−1)th buckets assembled with the rotor wheel and the nth bucket assembled with the adapter are collectively moved by one half pitch along the circumferential direction of the rotor.

The rotatable body may further include means for fixing the first to nth buckets in the predetermined position, wherein the fixing means comprises the rotor wheel, the adapter, and the n buckets.

The rotor wheel, the adapter, and the n buckets may be configured such that, when the n buckets are located in the predetermined position, the adapter moves outwards in a radial direction of the rotor to be caught by one or more buckets among the n buckets, thereby preventing the n buckets from moving in the circumferential direction of the rotor.

The rotor dovetail tenon may include an inner circumferential surface facing a rotational axis of the rotor; and an outer circumferential surface providing a rear surface of the inner circumferential surface. The adapter dovetail tenon may include an inner circumferential surface facing the rotational axis of the rotor; and an outer circumferential surface providing a rear surface of the inner circumferential surface. The bucket dovetail mortise may include a first inner circumferential surface facing the inner circumferential surface of the rotor dovetail tenon; a first outer circumferential surface facing the outer circumferential surface of the rotor dovetail tenon; a second inner circumferential surface facing the inner circumferential surface of the adapter dovetail tenon; and a second outer circumferential surface facing the outer circumferential surface of the adapter dovetail tenon.

A distance between the inner and outer circumferential surfaces of the rotor dovetail tenon, a distance between the first inner and outer circumferential surfaces of the bucket dovetail mortise, and a distance between the inner and outer circumferential surfaces of the adapter dovetail tenon may be substantially equal to each other and may be respectively smaller than a distance between the second inner and outer circumferential surfaces of the bucket dovetail mortise. A distance to the first inner circumferential surface of the bucket dovetail mortise from the rotational axis of the rotor may be substantial equal to a distance to the second inner circumferential surface of the bucket dovetail mortise from the rotational axis of the rotor, and a distance to the second outer circumferential surface of the bucket dovetail mortise from the rotational axis of the rotor may be greater than a distance to the first outer circumferential surface of the bucket dovetail mortise from the rotational axis of the rotor.

When the n buckets move in the circumferential direction of the rotor, the adapter may be moved inwards in the radial direction of the rotor, so that the inner circumferential surface of the adapter dovetail tenon comes into contact with the second inner circumferential surface of the bucket dovetail mortise and so that the outer circumferential surface of the adapter dovetail tenon is substantially coplanar with the first outer circumferential surface of the bucket dovetail mortise, thereby preventing the adapter dovetail tenon from being caught by a stepped portion between the first and second outer circumferential surface of the bucket dovetail mortise. When the n are located in the predetermined position, the adapter may be moved outwards in the radial direction of the rotor, so that the inner circumferential surface of the adapter dovetail tenon is spaced apart from the second inner circumferential surface of the bucket dovetail mortise and so that the outer circumferential surface of the adapter dovetail tenon occupies a different plane from the first outer circumferential surface of the bucket dovetail mortise, thereby causing the adapter dovetail tenon to be caught by the stepped portion between the first and second outer circumferential surfaces of the bucket dovetail mortise.

According to another aspect of the present invention, a steam turbine may include a casing; the above rotatable body, the rotatable body being rotatably provided in the casing; and a nozzle configured to discharge steam toward the rotatable body.

According to another aspect of the present invention, there is provided a method of manufacturing a rotatable body including a rotor and n buckets for converting energy of flowing steam into mechanical work, each bucket configured to be coupled to the rotor in a tangential entry manner, the rotor being configured to support each of the n buckets coupled to the rotor and including an adapter for coupling an nth bucket of the n buckets to the rotor, and a rotor wheel having a circumferential surface on which a tangential entry is provided, the adapter filling the tangential entry when the nth bucket is coupled to the rotor. The method may include assembling first to (n−1)th buckets with the rotor wheel by successively inserting the first to (n−1)th buckets through the tangential entry in a circumferential direction of the rotor; assembling the nth bucket with the adapter; assembling the adapter assembled with the nth bucket with the rotor wheel assembled with the first to (n−1)th buckets, by inserting the adapter assembled with the nth bucket into the tangential entry in an axial direction of the rotor; and collectively moving the first to (n−1)th buckets of the rotor wheel-and-bucket assembly and the nth bucket of the adapter-and-bucket assembly, by one half pitch along the circumferential direction of the rotor. The method may further include fixing the collectively moved buckets by moving the adapter outwards in a radial direction of the rotor.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will be more clearly understood from the following detailed description when taken in conjunction with the accompanying drawings, in which:

FIG. 1 is a perspective view of a portion of a rotatable body according to a related art;

FIG. 2 is a partially cutaway, front view of a steam turbine including a rotatable body in accordance with an embodiment of the present invention;

FIG. 3 is a flowchart of a method of manufacturing the rotatable body of FIG. 2;

FIGS. 4-8 are views of portions of the rotatable body of FIG. 2 for illustrating steps S2-S6 of FIG. 3, respectively;

FIG. 9 is an exploded perspective view of a portion of each of the (n−1)th and nth buckets of FIG. 2; and FIG. 10 is a perspective view illustrating a rotatable body manufactured by the rotatable body manufacturing method illustrated in FIG. 3.

DETAILED DESCRIPTION OF THE INVENTION

Hereinafter, a rotatable body, a method of manufacturing the same, and a steam turbine including the same according to the present invention will be described in detail with reference to the accompanying drawings.

Referring to FIG. 3, the steam turbine of the present invention may include a rotatable body 200 in accordance with an embodiment of the present invention; a casing 100 forming the turbine's outer appearance and frame, in which the rotatable body 200 is rotatably installed; and a nozzle (not shown) configured to discharge steam toward the rotatable body 200. The rotatable body 200 may include a rotor 300 provided to be rotatable, and a number (n) of buckets 400 coupled to the rotor 300 and configured to convert the energy of flowing steam discharged from the nozzle into mechanical work. The n buckets 400, the buckets 400(1) through 400(*n*), may be coupled to the rotor 300 in a so-called tangential entry manner. Each of the n buckets 400 may be formed to be supported by the rotor 300.

The rotor 300 may include a rotor wheel 310 and an adapter 320 coupled to the rotor wheel 310 in order to couple the closer bucket to the rotor 300. With the adapter 320 coupled to the rotor wheel 310, the rotor 300 may take on a disc shape.

As shown in FIGS. 4 and 6, a tangential entry 312 may occupy a position on the circumference of the rotor wheel 310 and may function as a slot to be filled with the adapter 320 and as an access point for the coupling of the buckets 400 to the rotor 300. Thus, the buckets 400 can be individually inserted into the tangential entry 312 in order to be coupled, one by one, to the rotor wheel 310 of the rotor 300.

The rotor wheel 310 may include a rotor dovetail tenon 314, occupying the majority of a circumferential surface of the rotor wheel 310 and protruding axially from the surface, and an axial dovetail mortise 316 formed as a recess to coincide with the position of the tangential entry 312. Thus, the rotor dovetail tenon 314 may extend, in a circumferential direction, from one side of the tangential entry 312 back around to the other side of the tangential entry 312, leaving a gap in the rotor dovetail tenon 314. The axial dovetail mortise 316 is effectively formed under the tangential entry 312 and may be recessed with respect to a radial direction (inward) of the rotor 300 and may extend in an axial direction (thickness) of the rotor 300.

As described above, the tangential entry 312 is a space functioning as the entrance for the buckets 400 to allow the buckets 400 to be coupled to the rotor 300 in an insertion manner along the circumferential direction. In order to allow insertion of each bucket 400 into the tangential entry 312, a circumferential length (arc) of the tangential entry 312 may be equal to or substantially equal to the width of one bucket 400 in the circumferential direction. Hereinafter, the terms "circumferential direction," "axial direction," and "radial direction" will respectively refer to the corresponding directions of the rotor 300.

Although the tangential entry 312 may have a size enabling multiple buckets 400 to simultaneously enter the tangential entry 312, it may be preferable that, as shown in the present embodiment, the tangential entry 312 have a size enabling only one bucket 400 at a time to enter the tangential entry 312, so as to minimize the size of the gap in the rotor dovetail tenon 314 that is formed by the tangential entry 312.

The rotor dovetail tenon 314, along with an adapter dovetail tenon 324 to be described below, may form a unified annular dovetail tenon R (FIG. 6) protruding axially from the circumferential surface of the rotor 300. The unified annular dovetail tenon R operates in conjunction with a bucket dovetail mortise 412 to be described below. Here, when the buckets 400 move in the circumferential direction, along the circumferential surface of the rotor 300, the unified annular dovetail tenon R and the bucket dovetail mortise 412 may function to guide movement of the buckets 400 in the circumferential direction. In addition, the unified annular dovetail tenon R and the bucket dovetail mortise 412 may function to support the buckets 400 and to prevent the buckets 400 from axially or radially separating from the rotor 300. The shape of a cross-section of the rotor dovetail tenon 314, taken perpendicularly to the circumferential direction, may be constant all along the circumference of the rotor 300, thus allowing each bucket 400 inserted through the tangential entry 312 to be moved in the circumferential direction. In order to prevent each bucket 400 coupled to the rotor dovetail tenon 314 from being separated from the rotor dovetail tenon 314 in the radial direction, the rotor dovetail tenon 314 may include at least one projection protruding in the axial direction and at least one depression recessed in the axial direction.

The axial dovetail mortise 316 operates in conjunction with an axial dovetail tenon 326 to be described below. The axial dovetail mortise 316 and the axial dovetail tenon 326 may function to allow the adapter 320 to be moved in the axial direction (insertion, extraction) and to be coupled to the rotor wheel 310. In addition, the axial dovetail mortise 316 and the axial dovetail tenon 326 may function to support the adapter 320 and to prevent the adapter 320 from being radially separated from the rotor wheel 310 and from moving with respect to the circumferential direction. The shape of a cross-section of the axial dovetail mortise 316, taken perpendicularly to the axial direction, may be constant along the axial direction, thus allowing an axial dovetail tenon 326 (to be described later) of the adapter 320 to be inserted into the axial dovetail mortise 316 and the adapter 320 to be moved in the axial direction. In order to prevent the adapter 320 coupled to the axial dovetail mortise 316 from being separated from the axial dovetail mortise 316 in the radial direction, the axial dovetail mortise 316 may include at least one projection protruding in the circumferential direction and at least one depression recessed in the circumferential direction.

The adapter 320 may include the adapter dovetail tenon 324 and the axial dovetail tenon 326, which, as described above, engages with the axial dovetail mortise 316. The adapter dovetail tenon 324 protrudes axially from a surface S of the adapter 320 (FIG. 5) and fills the gap in the rotor dovetail tenon 314. Moreover, together with a corresponding bucket 400, the adapter dovetail tenon 324 also fills the tangential entry 312. In other words, the adapter dovetail tenon 324 may have a circumferential length equivalent to that of the tangential entry 312.

The surface S of the adapter 320 is consistent with the circumferential surface of the rotor wheel 310 on which the rotor dovetail tenon 314 is formed. Combined with the surface S, the circumferential surface of the rotor wheel 310 coincides with the circumferential surface of the rotor wheel 310 on which the unified annular dovetail tenon R is formed.

As described above, the adapter dovetail tenon 324 may complete the unified annular dovetail tenon R along with the rotor dovetail tenon 314. That is, as in the case of the rotor dovetail tenon 314, the shape of a cross-section of the adapter dovetail tenon 324, taken perpendicularly to the circumferential direction, may be constant in the circumferential direction, thus allowing the buckets 400 to be moved in the circumferential direction. Further, also as in the case of the rotor dovetail tenon 314, in order to prevent the buckets 400 coupled to the adapter dovetail tenon 324 from being separated from the adapter dovetail tenon 324 in the radial direction, the adapter dovetail tenon 324 may include at least one projection protruding in the axial direction and at least one depression recessed in the axial direction. In other words, the adapter dovetail tenon 324 may include projections and recesses in the same manner as in the case of the rotor dovetail tenon 314, thus supporting at least one bucket 400 of the n buckets 400.

As shown in the present embodiment, and exemplified in FIG. 7, in the case where the n buckets 400 are collectively moved by one half pitch, the adapter dovetail tenon 324 may support a portion of an (n−1)th bucket 400(*n*−1) and a portion of an nth bucket 400*n*, i.e., the closer bucket. Before the n buckets 400 are collectively moved, the adapter dovetail tenon 324 may support one bucket 400 of the n buckets 400, namely, the nth bucket 400*n*.

To allow the axial dovetail tenon 326 to engage with the axial dovetail mortise 316, the shape of a cross-section of the axial dovetail tenon 326, taken perpendicularly to the axial direction, may be constant in the axial direction, and the axial dovetail tenon 326 may include at least one projection protruding in the circumferential direction and at least one depression recessed in the circumferential direction.

Each of the n buckets 400 may include a root 410 which is coupled to the rotor 300, and a blade 420 which protrudes from the root 410 in the rotational radial direction. The root 410 may include the bucket dovetail mortise 412 and a platform 414 (FIG. 4) encasing the bucket dovetail mortise 412. The bucket dovetail mortise 412 engages with a portion of the unified annular dovetail tenon R, and the platform 414 defines the outer appearance of the root 410. The bucket dovetail mortise 412 may have a circumferential length equivalent to that of the root 410.

To allow the bucket dovetail mortise 412 to engage with the unified annular dovetail tenon R, the shape of a cross-section of the bucket dovetail mortise 412, taken perpendicularly to the circumferential direction, may be constant in the circumferential direction, and the bucket dovetail mortise 412 may include at least one projection protruding in the axial direction and at least one depression recessed in the axial direction.

The rotatable body 200 in accordance with the present embodiment may be manufactured by the following method, to prevent axial movement of the adapter 320 and a bucket 400 supported on the adapter 320 and their becoming separated from the rotor wheel 310 and buckets 400 supported on the rotor wheel 310.

Referring to FIG. 3, the rotatable body 200 may be manufactured by a method including a first step S1 of providing the rotor 300 and the n buckets 400; a second step S2 of assembling first to (n−1)th buckets 400(1) to 400(*n*−1) with the rotor wheel 310; a third step S3 of assembling the nth bucket 400*n* with the adapter 320; a fourth step S4 of assembling the adapter 320 with the rotor wheel 310; and a fifth step S5 of moving the n buckets 400 in the circumferential direction.

In detail, a bucket 400 to be finally assembled among the n buckets 400 is referred to as the nth bucket 400*n*, a bucket 400 adjacent to the nth bucket 400*n* is referred to as the first bucket 400(1), and the other buckets 400 are respectively referred to as second to (n−1)th buckets 400(2) to 400(*n*−1) in a sequence from the first bucket 400(1) to the nth bucket 400*n* along the circumferential direction. At the steps S1 and S2, the first to (n−1)th buckets 400(1) to 400(*n*−1) may be successively assembled with the rotor wheel 310 by inserting the first to (n−1)th buckets 400(1) to 400(*n*−1) in the circumferential direction by way of the tangential entry 312, the rotor dovetail tenon 314, and the bucket dovetail mortise 412.

Thereafter, at the step S3, the nth bucket 400*n* may be assembled with the adapter 320 using the bucket dovetail mortise 412 of the nth bucket 400*n* and the adapter dovetail tenon 324 of the adapter 320.

Subsequently, at the step S4, the adapter 320 assembled with the nth bucket 400*n* may be assembled, by inserting the adapter 320 into the tangential entry 312 in the axial direction, with the rotor wheel 310 assembled with the first to (n−1)th buckets 400(1) to 400(*n*−1). In other words, when the axial dovetail tenon 326 is inserted into the axial dovetail mortise 316, the adapter dovetail tenon 324 is inserted into the tangential entry 312, thus forming the unified annular dovetail tenon R along with the rotor dovetail tenon 314. In addition, the nth bucket 400*n* that has engaged with the adapter dovetail tenon 324 is interposed between the first bucket 400(1) and the (n−1)th bucket 400(*n*−1).

Thereafter, at the step S5, the first to (n−1)th buckets 400(1) to 400(*n*−1) assembled with the rotor wheel 310 and the nth bucket 400*n* assembled with the adapter 320 may be collectively moved to a predetermined position along the circumferential direction.

Here, the predetermined position may be a position at which the root 410 of a specific bucket 400 of the n buckets 400 overlaps one junction between the rotor dovetail tenon 314 and the adapter dovetail tenon 324 and at which the root 410 of a bucket 400 adjacent to the specific bucket 400 overlaps the other junction between the rotor dovetail tenon 314 and the adapter dovetail tenon 324, with respect to the axial and radial directions.

In other words, if the circumferential length of the root 410 corresponds to one pitch, as described in the present embodiment, the predetermined position may be a position at which, by collectively moving the first to (n−1)th buckets 400(1) to 400(*n*−1) assembled with the rotor wheel 310 and the nth bucket 400*n* assembled with the adapter 320 by one half pitch in the circumferential direction, a central portion of the (n−1)th bucket 400(*n*−1) axially and radially overlaps one junction between the rotor dovetail tenon 314 and the adapter dovetail tenon 324, while a central portion of the nth bucket 400*n* axially and radially overlaps the other junction between the rotor dovetail tenon 314 and the adapter dovetail tenon 324.

Although the n buckets 400 are disposed at the predetermined position as the rotatable body 200 are formed through the steps S1 to S5, the n buckets 400 may be undesirably moved in the circumferential direction and become displaced from the predetermined position, for example, because of operation of the steam turbine. That is, the junctions between the rotor dovetail tenon 314 and the adapter dovetail tenon 324 may be respectively aligned with side surfaces of the root 410 of any bucket 400 among the n buckets 400 in the axial and radial directions. Thereby, the adapter 320 and the bucket 400 supported on the adapter 320 may be moved in the axial direction and become separated from the rotor wheel 310 and the other buckets 400 supported on the rotor wheel 310.

Given this, the rotatable body 200 in accordance with the present embodiment may further include a fixing unit for fixing the n buckets 400 at the predetermined position.

The fixing means may be comprised of the rotor wheel 310, the adapter 320, and the n buckets 400, instead of using separate components.

Specifically, the rotor wheel 310, the adapter 320, and the n buckets 400 may be configured such that, when the n buckets 400 are located in the predetermined position, the adapter 320 moves outwards in the radial direction to be caught by any bucket of the n buckets 400, thereby preventing the n buckets 400 from moving in the circumferential direction.

More specifically, first, the axial dovetail tenon 326 of the adapter 320 and the axial dovetail mortise 316 of the rotor wheel 310 may be configured such that the axial dovetail tenon 326 is movable in the radial direction when the axial dovetail tenon 326 and the axial dovetail mortise 316 are meshed.

That is, the axial dovetail tenon 326 may include inner circumferential surfaces 326*a* facing the rotational axis of the rotor 300, outer circumferential surfaces 326*b* forming rear surfaces of the inner circumferential surfaces 326*a*, and side surfaces 326*c* connecting the inner circumferential surfaces 326*a* and the outer circumferential surfaces 326*b*.

The axial dovetail mortise 316 may include inner circumferential surfaces 316*a* facing the inner circumferential surfaces 326*a* of the axial dovetail tenon 326, outer circumferential surfaces 316*b* facing the outer circumferential surfaces 326*b* of the axial dovetail tenon 326, and side surfaces 316*c* facing the side surfaces 326*c* of the axial dovetail tenon 326.

The distances between the inner circumferential surfaces 316*a* and the outer circumferential surfaces 316*b* of the axial dovetail mortise 316 may be greater than the distances between the inner circumferential surfaces 326*a* and the outer circumferential surfaces 326*b* of the axial dovetail tenon 326.

In addition, the side surfaces 316*c* of the axial dovetail mortise 316 and the side surfaces 326*c* of the axial dovetail tenon 326 may extend in the radial direction.

Afterwards, in a position in which the annular dovetail tenon R of the rotor 300 and the bucket dovetail mortise 412 of the bucket 400 are meshed, the adapter dovetail tenon 324 of the adapter 320 may be provided to be movable in the radial direction.

Specifically, the rotor dovetail tenon 314 may include inner circumferential surfaces 314*a* facing the rotational axis of the rotor 300, outer circumferential surfaces 314*b* forming rear surfaces of the inner circumferential surfaces 314*a*, and side surfaces 314*c* connecting the inner circumferential surfaces 314*a* and the outer circumferential surfaces 314*b*.

The adapter dovetail tenon 324 may include inner circumferential surfaces 324*a* facing the rotational axis of the rotor 300, outer circumferential surfaces 324*b* forming rear surfaces of the inner circumferential surfaces 324*a*, and side surfaces 324*c* connecting the inner circumferential surfaces 324*a* and the outer circumferential surfaces 324*b*.

The bucket dovetail mortise 412 may include first inner circumferential surfaces 412*a* facing the inner circumferences 314*a* of the rotor dovetail tenon 314, first outer circumferential surfaces 412*b* facing the outer circumferential surfaces 314*b* of the rotor dovetail tenon 314, first side surfaces 412*c* facing the side surfaces 314*c* of the rotor dovetail tenon 314, second inner circumferential surfaces 412*d* facing the inner circumferential surfaces 324*a* of the adapter dovetail tenon 324, second outer circumferential surfaces 412*e* facing the outer circumferential surfaces 324*b* of the adapter dovetail tenon 324, and side surfaces 412*f* facing the side surfaces 324*c* of the adapter dovetail tenon 324.

The first inner circumferential surfaces 412*a*, the first outer circumferential surfaces 412*b*, and the first side surfaces 412*c* of the bucket dovetail mortise 412 may be provided to match the n buckets 400, while the second inner circumferential surfaces 412*d*, the second outer circumferential surfaces 412*e*, and the second side surfaces 412*f* of the bucket dovetail mortise 412 may be provided to match the (n−1)th bucket 400(*n*−1) and the nth bucket 400*n*.

That is, the bucket dovetail mortise 412 of each of the first bucket 400(1) to the (n−2)th bucket 400(*n*−2) may include the first inner circumferential surfaces 412*a*, the first outer circumferential surfaces 412*b*, and the first side surfaces 412*c*. In contrast, the bucket dovetail mortise 412 of each of the (n−1)th bucket 400(*n*−1) and the nth bucket 400*n* may include the first inner circumferential surfaces 412*a*, the first outer circumferential surfaces 412*b*, the first side surfaces 412*c*, the second inner circumferential surfaces 412*d*, the second outer circumferential surfaces 412*e*, and the second side surfaces 412*f*.

Here, the first inner circumferential surfaces 412*a*, the first outer circumferential surfaces 412*b*, and the first side surfaces 412*c* of the bucket dovetail mortise 412 of the (n−1)th bucket 400(*n*−1) may extend to the first inner circumferential surfaces 412*a*, the first outer circumferential surfaces 412*b*, and the first side surfaces 412*c* of the bucket dovetail mortise 412 of the (n−2)th bucket 400(*n*−2), respectively. In addition, the first inner circumferential surfaces 412*a*, the first outer circumferential surfaces 412*b*, and the first side surfaces 412*c* of the bucket dovetail mortise 412 of the nth bucket 400*n* may extend to the first inner circumferential surfaces 412*a*, the first outer circumferential surfaces 412*b*, and the first side surfaces 412*c* of the bucket dovetail mortise 412 of the first bucket 400(1), respectively. Furthermore, the second inner circumferential surfaces 412*d*, the second outer circumferential surfaces 412*e*, and the second side surfaces 412*f* of the bucket dovetail mortise 412 of the (n−1)th bucket 400(*n*−1) may extend to the second inner circumferential surfaces 412*d*, the second outer circumferential surfaces 412*e*, and the second side surfaces 412*f* of the bucket dovetail mortise 412 of the nth bucket 400*n*, respectively.

Here, the distances between the inner circumferential surfaces 314*a* and the outer circumferential surfaces 314*b* of the rotor dovetail tenon 314, the distances between the first inner circumferential surfaces 412*a* and the first outer circumferential surfaces 412*b* of the bucket dovetail mortise 412, and the distances between the inner circumferential surfaces 324*a* and the outer circumferential surfaces 324*b* of the adapter dovetail tenon 324 may be the same or substantially the same as each other, and may be smaller than the distances between the second inner circumferential surfaces 412*d* and the second outer circumferential surfaces 412*e* of the bucket dovetail mortise 412.

Specifically, the distances to the first inner circumferential surfaces 412*a* of the bucket dovetail mortise 412 from the rotational axis of the rotor 300 may be determined to be the same or substantially the same as the distances to the second inner circumferential surfaces 412*d* of the bucket dovetail mortise 412, such that each of the first inner circumferential surfaces 412*a* of the bucket dovetail mortise 412 is flush with a corresponding second inner circumferential surface of the second inner circumferential surfaces 412*d* of the bucket dovetail mortise 412. In contrast, the distances to the second outer circumferential surfaces 412*e* of the bucket dovetail mortise 412 from the rotational axis of the rotor 300 may be determined to greater than the distances to the first outer circumferential surfaces 412*b* of the bucket dovetail mortise 412 from the rotational axis of the rotor 300, such that the first outer circumferential surfaces 412*b* of the bucket dovetail mortise 412 is stepped from the second outer circumferential surfaces 412*e* of the bucket dovetail mortise 412.

In addition, each of the side surfaces 314*c* of the rotor dovetail tenon 314, the first side surfaces 412*c* of the bucket dovetail mortise 412, the side surfaces 324*c* of the adapter dovetail tenon 324, and the second side surfaces 412*f* of the bucket dovetail mortise 412 may extend in the radial direction.

According to the above-described configuration, the second outer circumferential surfaces 412*e*, the second inner circumferential surfaces 412*e*, and the second side surfaces 412*f* of the bucket dovetail mortise 412 may define a space in which the adapter dovetail tenon 324 can move in the radial direction.

Here, the rotatable body manufacturing method according to the present embodiment may further include, after the step S5, a sixth step S6 of fixing the n buckets 400 by moving the adapter 320 outwards in the radial direction.

Specifically, in the rotatable body 200 according to the present embodiment, the adapter dovetail tenon 324 can accommodated within the space when the n buckets 400 are located in the predetermined position in the step S5. As the adapter dovetail tenon 324 is caught by stepped portions 412*g* between the outer circumferential surfaces 314*b* of the first circumferential dovetail protrusion 314 and the second outer circumferential surfaces 412*e* of the bucket dovetail mortises 412, in response to the adapter 320 being moved outwards in the radial direction, in the step S6, the n buckets 400 can be fixed in the predetermined position.

Hereinafter, the operations and effects of the rotatable body, the method of manufacturing the same, and the steam turbine including the same according to the present embodiment will be described.

Specifically, the nozzles (not shown) projects steam onto the n buckets 400 in the axial direction, and then the stem pass through the buckets 400 while being redirected by the buckets 400.

At this time, the steam applies an impulse to the buckets 400, so that the buckets 400 can rotate together with the rotor 300 in the circumferential direction, thereby converting energy extracted from steam into mechanical energy.

In the rotatable body, the method of manufacturing the same, and the steam turbine including the same according to the present embodiment, all of the n buckets 400 may be stably coupled to the rotor 300, in particular, using a tangential entry system. Specifically, in a position in which the first bucket 400(1) to the (n−1)th bucket 400(*n*−1) are connected to the rotor wheel 310, the nth bucket 400*n* is introduced into the tangential entry 312, and all of the n buckets 400 have moved in the circumferential direction to be located in the predetermined position, so that portions of the tangential entry 312 overlap portions of a specific bucket (e.g. the (n−1)th bucket 400(*n*−1)) among the n buckets 400 in the axial direction and radial direction while the remaining portions of the tangential entry 312 overlap portions of a bucket (e.g., the nth bucket 400*n*), among the n buckets 400, adjacent to the specific bucket, in the axial direction and radial direction. Consequently, even if a portion of the specific bucket 400 (e.g., the (n−1)th bucket 400(*n*−1)) is supported by the rotor dovetail tenon 314, and even if a portion of the adjacent bucket 400 (e.g., the nth bucket 400*n*) is supported by the rotor dovetail tenon 314, a significant load can be prevented from being concentrated on a specific dovetail portion, the dovetail can be prevented from being damaged by the concentration of the load, and the buckets 400 can be prevented from being dislodged from the rotor 300 due to the damage in the dovetail.

In addition, since all of the n buckets 400 are located in the predetermined position by moving in the circumferential direction by the steps S3 to S5, the adapter 320 and the buckets 400 can be prevented from being dislodged in the axial or radial direction, so that the n buckets 400 can be more stably coupled to the rotor 300.

In addition, since the n buckets 400 are fixed in the predetermined position in the step S6, the n buckets 400 can be prevented from being dislodged from the predetermined position. Consequently, the n buckets 400 can be more stably coupled to the rotor 300. It is also possible to prevent the problem of low efficiency, which would otherwise be caused by insufficient conversion of steam energy into mechanical work, due to increases in the rotation of the n buckets 400 with respect to the rotor in the circumferential direction during operations.

In addition, the n buckets 400 are fixed in the predetermined position due to the rotor wheel 310, the adapter 320, and the buckets 400, instead of using separate components, in the step S6. Consequently, it is possible to reduce the number of components, the weight, and the manufacturing costs of the rotatable body 200 and the steam turbine including the same.

According to the present embodiment, spaces are defined between the adapter 320 and the rotor wheel 310 and between the adapter 320 and the buckets 400, such that the adapter 320 can reciprocally move in the radial direction depending on the operating conditions of the steam turbine. Specifically, in a stopped position, the adapter 320 is moved inwards in the radial direction due to gravity or the like, so that the inner circumferential surfaces 324*a* of the adapter dovetail tenon 324 come into contact with the second inner circumferential surfaces 412*d* of the bucket dovetail mortise 412, the outer circumferential surfaces 324*b* of the adapter dovetail tenon 324 come into contact with the second outer circumferential surfaces 412*e* of the bucket dovetail mortise 412, and the outer circumferential surfaces 324*b* of the adapter dovetail tenon 324 are located coplanar with the first outer circumferential surfaces 412*b* of the bucket dovetail mortise 412. Consequently, the n buckets 400 can be released from the fixed position. In contrast, during operating, the adapter 320 is moved outwards in the radial direction, so that the inner circumferential surfaces 324*a* of the adapter dovetail tenon 324 are spaced apart from the second inner circumferential surfaces 412*d* of the bucket dovetail mortise 412, the outer circumferential surfaces 324*b* of the adapter dovetail tenon 324 come into the second outer circumferential surfaces 412*e* of the bucket dovetail mortise 412, and the outer circumferential surfaces 324*b* of the adapter dovetail tenon 324 are located on the other surfaces from the first outer circumferential surfaces 412*b* of the bucket dovetail mortise 412 (i.e., the surfaces farther from the center of rotation of the rotor 300). Consequently, the n buckets 400 can be fixed in the predetermined position. However, the present invention is not limited thereto, and the rotatable body may be configured such that the adapter 320 is press-fitted into one of the rotor wheel 310 and the buckets 400. That is, the adapter 320 may be configured to be moved outwards in the radial direction to maintain the n buckets 400 to be fixed in the predetermined position, regardless of the operating state of the steam turbine. In this case, substantially the same operation and effect with insignificant differences may be obtained; i.e., the adapter 320 is movable in the radial direction, so that the n buckets 400 are fixed by the adapter 320. However, in this case, although residual stress due to press fitting is present, collision between the adapter 320 and the rotor wheel 310 and collision between the adapter 320 and the buckets 400 can be prevented, and noise and vibration can be reduced.

In addition, according to the present embodiment, the adapter 320, including the axial dovetail mortise 316 and the axial dovetail tenon 326, can be attached to and detached from the rotor wheel 310 by moving in the axial direction. The adapter 320 can be prevented from being dislodged from the rotor wheel 310 in the circumferential or radial direction. However, the present embodiment is not limited thereto, and although not shown, neither the axial dovetail mortise 316 nor the axial dovetail tenon 326 may be provided. In this case, the operation and effect, regarding the n buckets 400 being supported by the rotor 300, may be substantially the same and be insignificantly different from those of the present embodiment. However, in this case, the adapter 320 may be easily connected to and disconnected from the rotor wheel 310, since the adapter 320 is attachable to and detachable from the rotor wheel 310 by moving not only in the axial direction but also in the radial direction.

In addition, according to the present embodiment, the n buckets 400 are moved by half pitches in the step S5. However, the present embodiment is not limited thereto.

Specifically, the predetermined position may be a position at which all of the buckets, including the first bucket 400(1) to the (n−1)th bucket 400(*n*−1) connected to the rotor wheel 310 and the nth bucket 400*n* connected to the adapter 320, have arrived by moving distances greater than zero pitches and smaller than one half pitch, or distances greater than one half pitch and smaller than one pitch, in the circumferential direction. Consequently, a contact portion between the rotor dovetail tenon 314 and the adapter dovetail tenon 324 may overlap the (n−1)th bucket 400(*n*−1), more particularly, portions of the (n−1)th bucket 400(*n*−1) offset from the central portion of the (n−1)th bucket 400(*n*−1), in the axial direction and radial direction. In addition, the remaining contact portion between the rotor dovetail tenon 314 and the adapter dovetail tenon 324 may overlap the nth bucket 400*n*, more particularly, portions of the nth bucket 400*n* offset from the center portions of the nth bucket 400*n* in the axial direction and radial direction. In this case, the operation and effect, regarding the adapter 320 and the buckets 400 being prevented from being disconnected in the axial direction, may be substantially the same as and be insignificantly different from those of the present embodiment. However, this case may be disadvantageous in terms of a stress-related design.

Alternatively, the predetermined position may be a position at which all of the buckets, including the first bucket 400(1) to the (n−1)th bucket 400(*n*−1) connected to the rotor wheel 310 and the nth bucket 400*n* connected to the adapter 320, have arrived by moving distances greater than one pitch. For example, in the predetermined position, a contact portion between the rotor dovetail tenon 314 and the adapter dovetail tenon 324 overlaps the (n−2)th bucket 400(*n*−2) in the axial direction and radial direction, and the remaining contact portion between the rotor dovetail tenon 314 and the adapter dovetail tenon 324 overlaps the (n−1)th bucket 400(*n*−1) in the axial direction and radial direction. In this case, the operation and effect, regarding the adapter 320 and the buckets 400 being prevented from being disconnected in the axial direction, may be substantially the same as and be insignificantly different from those of the present embodiment. However, in this case, the n buckets 400 must be moved significant distances, thereby significantly increasing time and costs consumed in manufacture.

In addition, the dovetail tenons and the dovetail mortises may be provided in a reversed manner.

Specifically, the rotor 300 may be provided with a first bucket dovetail mortise and a second bucket dovetail mortise instead of the rotor dovetail tenon 314 and the adapter dovetail tenon 324, while the root 410 of each of the buckets 400 may be provided with a circumferential dovetail tenon instead of the bucket dovetail mortise 412.

In addition, the rotor wheel 310 may be provided with an axial dovetail tenon instead of the axial dovetail mortise 316, while the adapter 320 may be provided with an axial dovetail mortise instead of the axial dovetail tenon 326.

Although the exemplary embodiments of the present invention have been described for illustrative purposes, those skilled in the art will appreciate that various modifications, additions and substitutions are possible, without departing from the scope and spirit of the present invention as disclosed in the accompanying claims.

What is claimed is:

1. A rotatable body comprising:

a rotor; and n buckets for converting energy of flowing steam into mechanical work, the n buckets including first to (n−1)th buckets and an nth bucket as a closer bucket, each of the first to (n−1)th buckets and the closer bucket configured to be coupled to the rotor in a tangential entry manner, wherein the rotor is configured to support each of the n buckets coupled to the rotor and comprises:

an adapter for coupling the nth bucket to the rotor; and a rotor wheel that includes a circumferential surface on which a tangential entry is provided and a rotor dovetail tenon extending in a circumferential direction of the rotor from one side of the tangential entry to the other side of the tangential entry, the rotor dovetail tenon having a gap at the tangential entry, wherein the adapter includes an adapter dovetail tenon configured to fill the gap in the rotor dovetail tenon when the nth bucket is coupled to the rotor, wherein the first to (n1)th buckets are inserted through the tangential entry and then slid in the circumferential direction of the rotor on the rotor dovetail tenon in order to successively assemble the first to (n−1)th buckets with the rotor wheel, wherein the nth bucket is assembled with the adapter and the adapter assembled with the nth bucket is inserted into the tangential entry in an axial direction of the rotor in order to assemble the nth bucket with the rotor wheel, and wherein the first to (n−1)th buckets assembled with the rotor wheel and the nth bucket assembled with the adapter are collectively moved to a predetermined position along the circumferential direction of the rotor.

2. The rotatable body according to claim 1, further comprising:

a unified annular dovetail tenon protruding axially from a circumferential surface of the rotor, wherein each of the n buckets includes a bucket dovetail mortise for engaging with the unified annular dovetail tenon in order to couple the bucket to the rotor.

3. The rotatable body according to claim 1, wherein the adapter is configured to fill the tangential entry when the nth bucket is coupled to the rotor.

4. The rotatable body according to claim 3, wherein the adapter is configured to be coupled to the rotor wheel by moving the adapter in an axial direction of the rotor, and wherein the rotor wheel includes an axial dovetail mortise, extending in an axial direction of the rotor, configured to receive the adapter at the tangential entry.

5. The rotatable body according to claim 1, wherein the rotor dovetail tenon and the adapter dovetail tenon form a unified annular dovetail protrusion protruding axially from a circumferential surface of the rotor.

6. The rotatable body according to claim 5, wherein each of the n buckets comprises:

a root including a bucket dovetail mortise to engage with a portion of the unified annular dovetail protrusion; and a blade protruding from the root in a radial direction of the rotor, wherein, with respect to the circumferential direction of the rotor, a length of the tangential entry, a length of the adapter dovetail tenon, a length of the root, and a length of the bucket dovetail mortise are substantially identical lengths.

7. The rotatable body according to claim 1, wherein the (n−1)th bucket axially and radially overlaps a first junction between the rotor dovetail tenon and the adapter dovetail tenon, and the nth bucket axially and radially overlaps a second junction between the rotor dovetail tenon and the adapter dovetail tenon.

8. The rotatable body according to claim 7, wherein, when a length of a bucket of the n buckets with respect to the circumferential direction of the rotor is one pitch, the predetermined position is a position to which the first to (n−1)th buckets assembled with the rotor wheel and the nth bucket assembled with the adapter are collectively moved by one half pitch along the circumferential direction of the rotor.

9. The rotatable body according to claim 7, further comprising:

means for fixing the first to nth buckets in the predetermined position, wherein the fixing means comprises the rotor wheel, the adapter, and the n buckets.

10. The rotatable body according to claim 9, wherein the rotor wheel, the adapter, and the n buckets are configured such that, when the n buckets are located in the predetermined position, the adapter moves outwards in a radial direction of the rotor to be caught by one or more buckets among the n buckets, thereby preventing the n buckets from moving in the circumferential direction of the rotor.

11. The rotatable body according to claim 10, wherein the rotor dovetail tenon comprises:

an inner circumferential surface facing a rotational axis of the rotor; and an outer circumferential surface providing a rear surface of the inner circumferential surface, the adapter dovetail tenon comprises:

an inner circumferential surface facing the rotational axis of the rotor; and an outer circumferential surface providing a rear surface of the inner circumferential surface, and the bucket dovetail mortise comprises:

a first inner circumferential surface facing the inner circumferential surface of the rotor dovetail tenon;

a first outer circumferential surface facing the outer circumferential surface of the rotor dovetail tenon;

a second inner circumferential surface facing the inner circumferential surface of the adapter dovetail tenon; and a second outer circumferential surface facing the outer circumferential surface of the adapter dovetail tenon.

12. The rotatable body according to claim 11, wherein a distance between the inner and outer circumferential surfaces of the rotor dovetail tenon, a distance between the first inner and outer circumferential surfaces of the bucket dovetail mortise, and a distance between the inner and outer circumferential surfaces of the adapter dovetail tenon are substantially equal to each other and are respectively smaller than a distance between the second inner and outer circumferential surfaces of the bucket dovetail mortise.

13. The rotatable body according to claim 12, wherein a distance to the first inner circumferential surface of the bucket dovetail mortise from the rotational axis of the rotor is substantially equal to a distance to the second inner circumferential surface of the bucket dovetail mortise from the rotational axis of the rotor, and a distance to the second outer circumferential surface of the circumferential dovetail mortise from the rotational axis of the rotor is greater than a distance to the first outer circumferential surface of the circumferential dovetail mortise from the rotational axis of the rotor.

14. The rotatable body according to claim 13, wherein, when the n buckets move in the circumferential direction of the rotor, the adapter is moved inwards in the radial direction of the rotor, so that the inner circumferential surface of the adapter dovetail tenon comes into contact with the second inner circumferential surface of the bucket dovetail mortise and so that the outer circumferential surface of the adapter dovetail tenon is substantially coplanar with the first outer circumferential surface of the bucket dovetail mortise, thereby preventing the adapter dovetail tenon from being caught by a stepped portion between the first and second outer circumferential surface of the bucket dovetail mortise.

15. The rotatable body according to claim 14, wherein, when the n are located in the predetermined position, the adapter is moved outwards in the radial direction of the rotor, so that the inner circumferential surface of the adapter dovetail tenon is spaced apart from the second inner circumferential surface of the bucket dovetail mortise and so that the outer circumferential surface of the adapter dovetail tenon occupies a different plane from the first outer circumferential surface of the bucket dovetail mortise, thereby causing the adapter dovetail tenon to be caught by the stepped portion between the first and second outer circumferential surfaces of the bucket dovetail mortise.

16. A steam turbine comprising:

a casing;

the rotatable body according to claim 1, the rotatable body being rotatably provided in the casing; and a nozzle configured to discharge steam toward the rotatable body.

17. A method of manufacturing a rotatable body comprising a rotor and n buckets for converting energy of flowing steam into mechanical work, each bucket configured to be coupled to the rotor in a tangential entry manner, the rotor being configured to support each of the n buckets coupled to the rotor and including an adapter for coupling an nth bucket of the n buckets to the rotor, and a rotor wheel having a circumferential surface on which a tangential entry is provided, the adapter filling the tangential entry when the nth bucket is coupled to the rotor, the method comprising:

assembling first to (n−1)th buckets with the rotor wheel by successively inserting the first to (n−1)th buckets through the tangential entry in a circumferential direction of the rotor;

assembling the nth bucket with the adapter;

assembling the adapter assembled with the nth bucket with the rotor wheel assembled with the first to (n−1)th buckets, by inserting the adapter assembled with the nth bucket into the tangential entry in an axial direction of the rotor; and collectively moving the first to (n−1)th buckets of the rotor wheel-and-bucket assembly and the nth bucket of the adapter-and-bucket assembly, by one half pitch along the circumferential direction of the rotor.

18. The method according to claim 17, further comprising:

fixing the collectively moved buckets by moving the adapter outwards in a radial direction of the rotor.

* * * * *